US005180536A

United States Patent [19]

Bruckner et al.

[11] Patent Number: 5,180,536

[45] Date of Patent: Jan. 19, 1993

[54] METHOD AND APPARATUS FOR INSERTING A POURING PIPE INTO A MOLD OF A CONTINUOUS CASTING MACHINE

[75] Inventors: Raimund Bruckner, Engenhahn; Peter Keutgen, Kreuzau; Andreas Donner, Aachen, all of Fed. Rep. of Germany

[73] Assignee: Didier-Weke AG, Wiesbaden, Fed. Rep. of Germany

[21] Appl. No.: 731,278

[22] Filed: Jul. 17, 1991

[30] Foreign Application Priority Data

Jul. 20, 1990 [DE] Fed. Rep. of Germany ..... 4023077

[51] Int. Cl.[5] ..... B22D 41/56

[52] U.S. Cl. ..... 266/44; 222/606; 222/590

[58] Field of Search ..... 266/236, 44; 222/591, 222/606, 607, 590

[56] References Cited

U.S. PATENT DOCUMENTS 3,907,022 9/1975 Simons ..... 164/82
4,222,505 9/1980 Daussan et al. ..... 222/607
4,381,102 4/1983 King ..... 222/607

FOREIGN PATENT DOCUMENTS 0192019 12/1985 European Pat. Off. .
2709727 9/1977 Fed. Rep. of Germany .
2424095 11/1979 France .

*Primary Examiner*—Scott Kastler
*Attorney, Agent, or Firm*—Wenderoth, Lind & Ponack

[57] ABSTRACT

A method and apparatus are disclosed for inserting a pouring pipe into a mold of a continuous casting machine. The pouring pipe is mounted in a truck, and the truck and pouring pipe combination are then mounted on a conveyor mechanism such that the pouring pipe is set in a substantially horizontal starting position. From this substantially horizontal starting position, the pouring pipe is guided along a pair of guide rails of the conveyor mechanism such that is pivots into a substantially vertical position and is moved into a waiting position wherein its lower end is inserted into the mold. In this waiting position, the pouring pipe is offset laterally from but aligned with a casting opening in the bottom wall of the metallurgical vessel. From this waiting position, the pouring pipe can be forced by a pusher mechanism into a pouring position beneath the casting opening of the metallurgical vessel, such that molten metal can be poured from the metallurgical vessel into the mold via a pouring pipe. This procedure can be repeated by moving a new pouring pipe into the waiting position, after a pouring pipe in the waiting position has been moved from the waiting position into the pouring position, thereby displacing the eroded pouring pipe from the pouring position into a discharge position from which it can be removed from the continuous casting machine.

40 Claims, 6 Drawing Sheets

METHOD AND APPARATUS FOR INSERTING A POURING PIPE INTO A MOLD OF A CONTINUOUS CASTING MACHINE

BACKGROUND OF THE INVENTION

1. Field of the Invention

The present invention is, in general, directed to a method and apparatus for inserting a pouring pipe into a mold of a continuous casting machine, and more specifically, to such a method and apparatus wherein the pouring pipe is transferred from a substantially horizontal starting position outside the mold to a substantially vertical waiting position with at least a bottom portion of the pouring pipe inserted into the mold. The method and apparatus also allow for the pouring pipe to be moved from the waiting position into a pouring position directly beneath a casting opening of a metallurgical vessel.

2. Description of the Prior Art

In use of a continuous casting machine, since a pouring pipe is to be disposed in a pouring position wherein its upper end is attached to a metallurgical vessel and its lower end projects into a mold, it is necessary that the distance between the bottom wall of the metallurgical vessel and the upper opening of the mold be significantly shorter than the length of the pouring pipe. Therefore, it is difficult to insert the pouring pipe from a position outside the mold into its substantially vertical pouring position due to the lack of space between the bottom of the metallurgical vessel and the top of the mold, and it is necessary to perform such insertion of the pouring pipe with the pouring pipe in a substantially horizontal position.

In European patent 0 192 019 A1, a method is disclosed for manually inserting a pouring pipe sideways into the space between the metallurgical vessel and the mold, and then pivoting the pouring pipe into its vertical position, in which a head plate at the top of the pouring pipe is received on guide rails at a waiting position. From this waiting position, the pouring pipe can be pushed by a pusher mechanism into a casting position directly beneath a casting opening of the metallurgical vessel. The arrangement can be such that, if a previously used and eroded or worn pouring pipe is in the pouring position, it can be pushed along the guide rails from its pouring position as the new pouring pipe is moved from the waiting position into the pouring position. However, this method disclosed in European patent 0 192 019 A1 is disadvantageous in that the manual work which it requires is quite time consuming and, since the manual work must be performed by an operator present in the very high temperature area of the casting machine, the work can be quite burdensome for the operator.

In FR-OS 2 424 095, an apparatus is disclosed for inserting a pouring pipe beneath the casting opening of a metallurgical vessel. This apparatus includes two supporting frames for supporting the pouring pipes. The frames are made of a refractory material and can be pivoted about two axes that are perpendicular relative to one another and the axis of the casting opening. The pouring pipe is supported by the two supporting frames in such a manner that it is, itself, pivotable relative to the supporting frames about an axis. The numerous degrees of freedom provided by this apparatus for the movement of the pouring pipe allows the upper end of the pouring pipe to be moved into abutment with the bottom contact surface of a stationary bottom refractory plate at the casting opening of the metallurgical vessel. Furthermore, the supporting frames of this apparatus are movable on rails attached to the bottom wall of the metallurgical vessel, such that the pouring pipe can be moved into or out of position beneath the casting opening of the metallurgical vessel. However, to perform this operation, it is necessary that the metallurgical vessel be lifted relative to the mold due to the vertical positioning of the pouring pipe. In addition, the apparatus disclosed in FR-OS 2 424 095 is of a quite complicated and expensive construction.

SUMMARY OF THE INVENTION

Accordingly, an object of the present invention is to provide a method and apparatus for inserting a pouring pipe into a mold of a continuous casting machine which are free from the above-noted disadvantages inherent in the prior art.

A further object of the present invention is to provide such method and apparatus with which a pouring pipe can be inserted in a simple and reliable manner into the mold, without the casting machine operator having to perform complicated manipulations of the pouring pipe and without the casting machine operator being directly exposed to the high temperatures present at the casting machine.

These objects are obtained according to the present invention by providing a conveyor for conveying the pouring pipe from a starting position to a waiting position in which its bottom end is inserted into the mold. The only step which must be performed manually is that of removing the pouring pipe from the heater and mounting it on the conveyor in its starting position. In the starting position, the pouring pipe is oriented substantially horizontally (i.e. either horizontally or approximately horizontally), such that upon transporting of the pouring pipe from its starting position to the waiting position, the pouring pipe can fit through the relatively narrow space between the metallurgical vessel and the mold. So that the pouring pipe can be moved from its substantially horizontal starting position t its substantially vertical waiting position in which its bottom end is inserted in the mold, the conveyor is arranged to automatically guide the pouring pipe to pivot from its substantially horizontal position to its substantially vertical position as it is transported to the waiting position beneath the casting opening of the metallurgical vessel. With this arrangement, the pouring pipe can be transported into its waiting position in a quick and reliable manner, without it being necessary to lift the metallurgical vessel relative to the mold.

After the pouring pipe has been transported to its waiting position wherein it is inserted into the mold, the conveyor, or at least portions thereof, can be removed from the area adjacent the upper opening of the mold, so that the conveyor, or the portions thereof, are not continuously subjected to the high temperatures present above the mold. The apparatus according to the invention can be provided with a relatively simply construction with which to carry out the method of the present invention, wherein the conveyor includes guide rails, and a truck, within which the pouring pipe can be suspended and which can be moved along the guide rails from the substantially horizontal starting position to the substantially vertical waiting position. The automatic pivotal movement of the pouring pipe from its substantially horizontal position into its substantially vertical position is caused by the configuration and design of the guide rails. The guide rails include an upper guide rail and a lower guide rail, and the truck from which the pouring pipe can be suspended is guided along the upper and lower guide rails by first and second guide rollers which are mounted to the truck. Of course, the guide rails and guide rollers can be replaced by any other suitable guide elements.

Both the upper and lower guide rails extend from a remote position outside of the metallurgical vessel and the mold into the region between the metallurgical vessel and the mold. The transfer of the pouring pipe from its substantially horizontal starting position to its substantially vertical waiting position is facilitated by a configuration of the guide rails wherein the lower guide rail includes a first horizontal segment adjacent the starting position of the pouring pipe, and intermediate downwardly sloping segment, and a final segment which is substantially horizontal or slopes slightly upwardly and is disposed adjacent the waiting position of the pouring pipe. The upper guide rail includes a first segment adjacent the starting position of the pouring pipe which is horizontal or slopes slightly upwardly, and a final segment, adjacent the waiting position of the pouring pipe, which slopes upwardly and extends to a position adjacent the casting opening of the metallurgical vessel. The upper guide rail is preferably formed by two guide legs spaced vertically apart by a constant distance, such that the first guide rollers of the truck can engage and be guided between the two guide legs in a reliable manner.

Also, in order to stabilize the movement of the pouring pipe as it is transported from its starting position to its waiting position, it is preferable that the first guide roller comprises a pair a rollers which are rotatable about a common axis and are spaced a predetermined distance apart. This dual roller arrangement for the first guide roller provides a more stable support for the pouring pipe in the lateral direction of the guide rails.

In order to move the pouring pipe from its starting position to its waiting position without the need to manually manipulate the pouring pipe, a displacement mechanism is provided. The displacement mechanism includes an actuating rod which can be guided along a guide rail, preferably the upper guide rail, such that it pushes the pouring pipe into its waiting position. The actuating rod is preferably engaged with the first guide roller or its axle, so as to avoid tilting of the pouring pipe as the pouring pipe is transported from its starting position to its waiting position. A stop means is provided for preventing the pouring pipe from being displaced beyond its waiting position by the actuating rod. In addition, a holding means is provided to hold the actuating rod in its most extended position, whereby the pouring pipe is held in its waiting position.

So that the pouring pipe can be moved from its waiting position into a pouring position beneath the casting opening of the metallurgical vessel, a pusher mechanism is provided, and the truck from which the pouring pipe is suspended is arranged such that the pouring pipe can be pushed by the pusher mechanism from its waiting position, wherein it becomes disengaged from the truck and is moved laterally, relative to the guide rails, into its pouring position. In this pushing operation, a head plate mounted at the upper end of the pouring pipe is forced into a gap between a guide plate mounted to the metallurgical vessel and a plurality of contact strips. The contact strips are spring biased upwardly toward the guide plate such that when the head plate of the pouring pipe is disposed between the contact strips and the guide plate, the head plate of the pouring pipe is properly abutted against the guide plate of the metallurgical vessel so as to provide a reliable seal therebetween. In addition, in order to aid in the movement of the head plate into the gap between the guide plate and the contact strips, each of the contact strips is provided with a sloped portion to guide the head plate into the gap.

In order to bias the contact strips upwardly to cause the head plate of the pouring pipe to seal against the guide plate of the metallurgical vessel, a plurality of torsion rods can be provided. The torsion rods are preferably connected to the contact strips by swivel arms extending between the torsion rods and the contact strips, respectively. It is also preferable that the spring force provided by the torsion rods be made adjustable by way of, for example, set screws. Also, in order to avoid excessive force against the guide plate of the metallurgical vessel, the range of movement of the swivel arms can be limited by an adjustable stop member.

A pair of seating shoulders are provided on the side of the pouring position of the pouring pipe opposite the waiting position of the pouring pipe. These seating shoulders are adapted to receive the head plate of the pouring pipe after it has been used and has become eroded or worn. The seating shoulders are preferably attached to the contact strips, but can, of course, be mounted in any other suitable position such as, for example, to the bottom wall of the metallurgical vessel.

BRIEF DESCRIPTION OF THE DRAWINGS

Other advantages, features and applications of the present invention will be apparent from the following detailed description of the invention when read in conjunction with the drawing figures, in which.

DETAILED DESCRIPTION OF THE INVENTION

Figure 1:
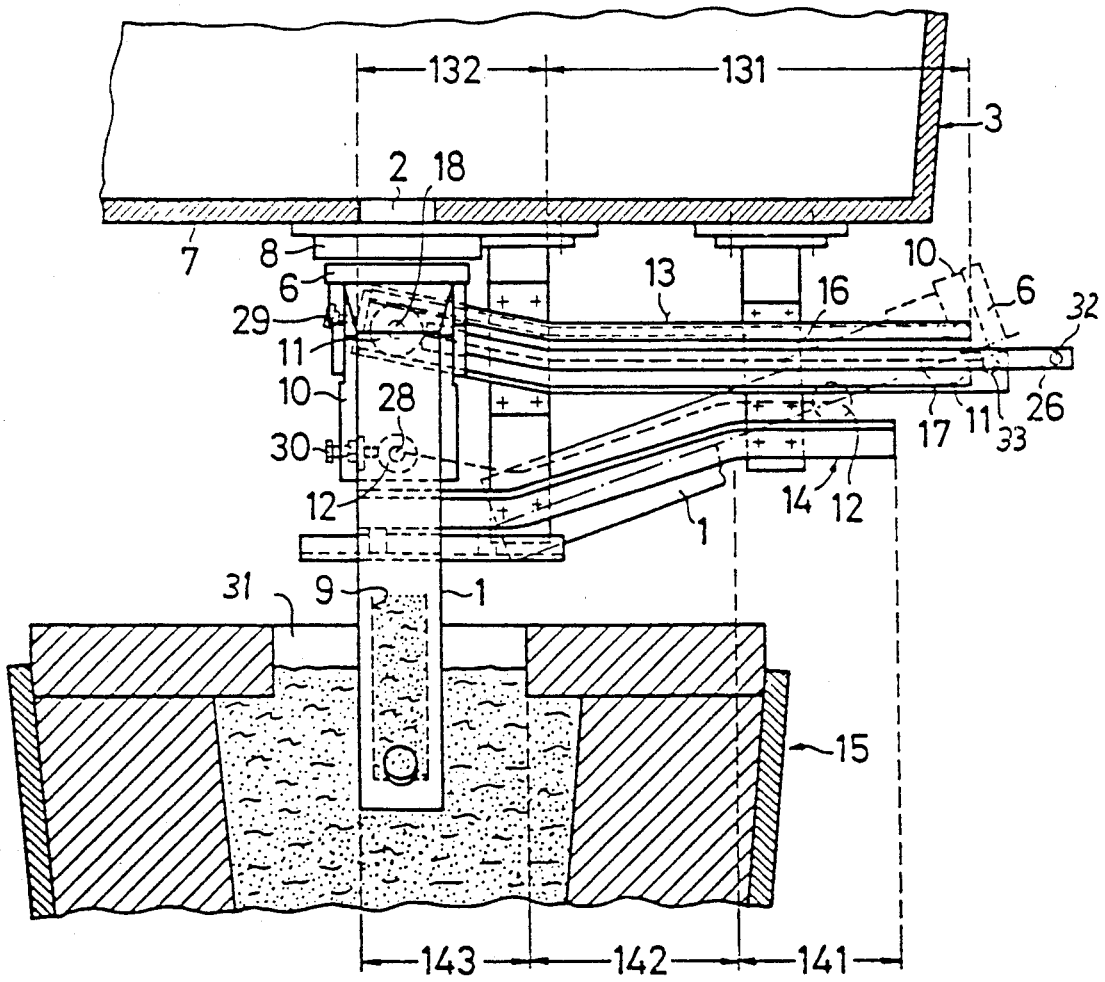
FIG. 1 is a schematic side view of an apparatus according to the present invention for inserting a pouring pipe into a mold of a continuous casting machine.
Figure 2:
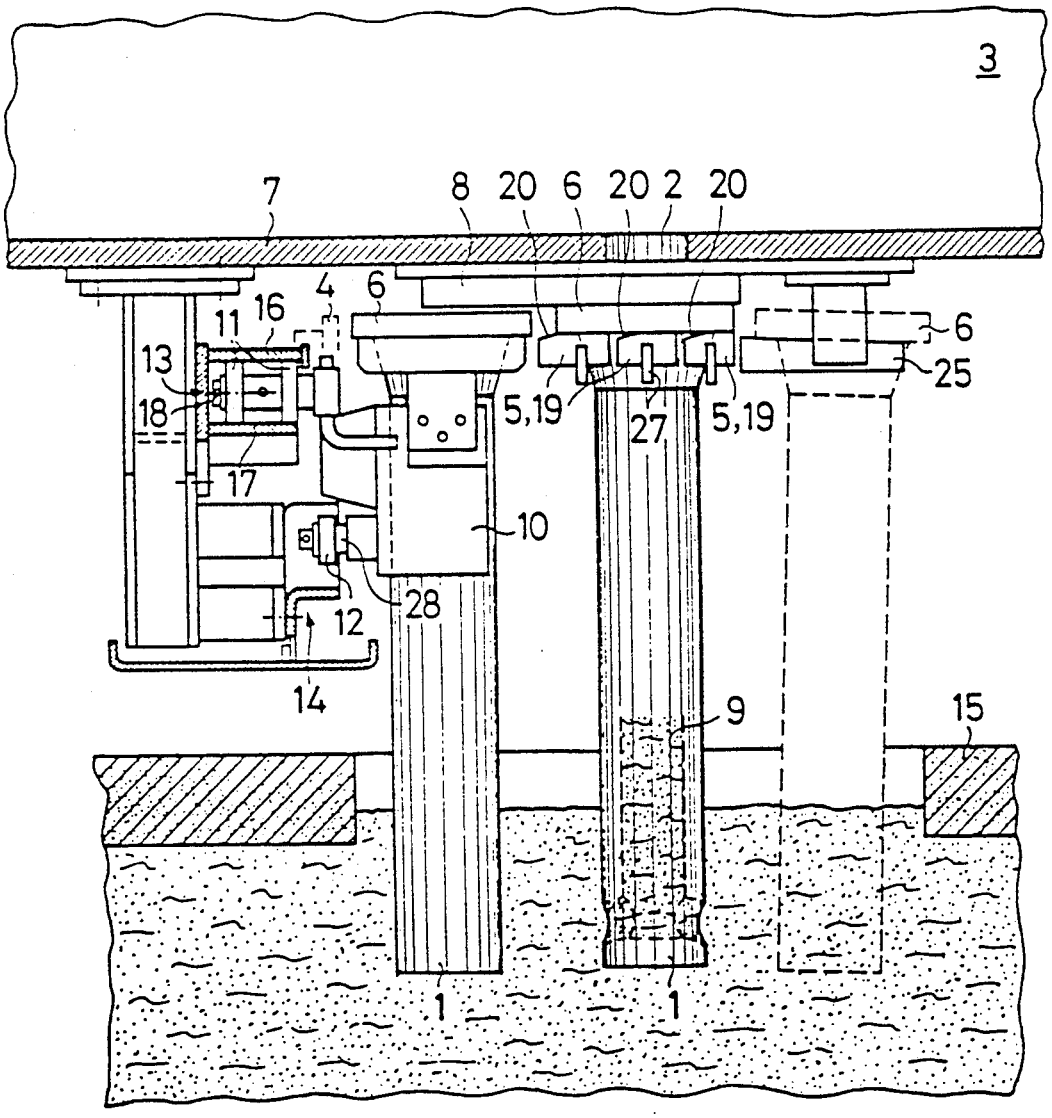
FIG. 2 is a front view of the apparatus shown in FIG. 1.
Figure 3:
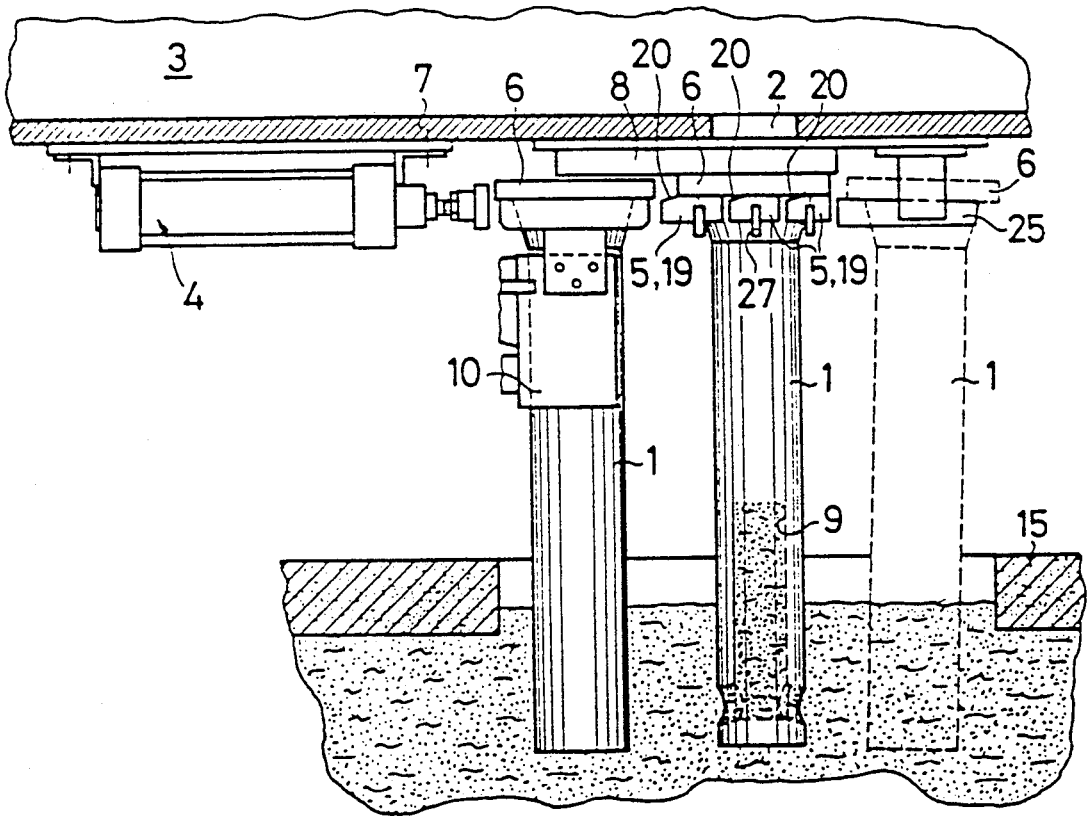
FIG. 3 is a view taken in the same direction as FIG. 2, but showing a pusher mechanism for pushing the pouring pipe from a waiting position into a pouring position.

FIGS. 1-3 show, in cross section, a metallurgical vessel 3 having a bottom wall 7 with a casting opening 2 formed therethrough, and a mold 15 having an upper opening 31. During pouring of molten metal from the metallurgical vessel 3 into the mold 15, a pouring pipe 1 is arranged beneath the casting opening 2 of the metallurgical vessel in a substantially vertical orientation such that a bottom portion thereof extend into the mold 15 through the upper opening 31 and molten metal can flow through a flow channel 9 of the pouring pipe 1.

This vertical position of the pouring pipe 1 beneath the casting opening 2 is known as the casting position or pouring position. As is clear from the drawing figures, the distance between the mold 15 and the bottom wall 7 of the metallurgical vessel 3 is significantly shorter than the length of the pouring pipe 1. Therefore, to insert the pouring pipe 1 into its vertical pouring position, it is necessary to orient the pouring pipe 1 in a horizontal or approximately horizontal (hereinafter referred to as substantially horizontal) position, such that it can be fitted between the metallurgical vessel 3 and mold 15.

As shown in FIG. 1, a conveyor mechanism is provided for transporting the pouring pipe 1 from a substantially horizontal starting position (as shown in dashed lines) to a substantially vertical waiting position (as shown in solid lines). The movement of pouring pipe 1 takes place along a plane coincident with the plane of the paper of FIG. 1 and perpendicular to the plane of the paper of FIGS. 2 and 3. From the substantially vertical waiting position, the pouring pipe 1 can be pushed by a pusher mechanism 4 (see FIG. 3), such that a head plate 6 fixed to the upper end of the pouring pipe 1 is received on guide rails 5 beneath a guide plate 8 mounted to the bottom wall 7 of the metallurgical vessel 3, until the pouring pipe reaches its pouring position beneath the casting opening 2 in the bottom wall 7 of the metallurgical vessel 3 (i.e. the middle position of the pouring pipe as shown in FIGS. 2 and 3). The movement of the pouring pipe from its waiting position to its pouring position is along a plane perpendicular to the plane of the paper of FIG. 1 and parallel to the plane of the paper of FIGS. 2 and 3. In FIGS. 2 and 3, the leftmost position of the pouring pipe 1 is the waiting position, the center position of the pouring pipe 1 is the pouring position, and the rightmost position in which the pouring pipe is shown in dashed lines is a discharge position from which the pouring pipe can be removed from the continuous casting machine.

The conveyor mechanism of the present invention includes an upper guide rail 13, a lower guide rail 14 and a truck 10 from which the pouring pipe 1 can be suspended. As shown in FIGS. 1 and 2, the truck 10 includes a first guide roller 11 which is adapted to be guided along the upper guide rail, and a second guide roller 12 which is adapted to be guided along the lower guide rail. The first and second rollers 11, 12 of the truck 10 are spaced apart from one another in such a manner that, due to the configuration of the upper and lower guide rails, when the pouring pipe 1 is moved along the guide rails from its starting position to its waiting position, the pouring pipe is automatically pivoted from a substantially horizontal position to a substantially vertical position in which its head plate 6 is positioned adjacent the guide plate 8, and its lower end is inserted into the mold 15. In order to guide the pouring pipe from its starting position to its waiting position, the truck 10, and thus the pouring pipe 1, are guided by the upper and lower guide rails 13, 14 by way of the first and second guide rollers 11, 12. The first guide roller 11 is preferably formed by two roller elements 11*a*, 11*b* which are both rotatable about the same axis 18. The second guide roller 12 is rotatable about an axis 28 which is spaced apart from but parallel to the axis 18 of the first roller 11. The first guide roller 11 is guided along the upper guide rail 13 between the upper and lower guide legs 16, 17 thereof, and the second guide roller is guided along the lower guide rail 14.

As mentioned above, in order to cause the pivotal motion of the pouring pipe 1 from its substantially horizontal position to its substantially vertical position, the guide rails are provided with a predetermined configuration, wherein the lower guide rail 14 includes first substantially horizontal segment 141, an intermediate downwardly sloping segment 142, and a final segment 143 which is substantially horizontal or slightly inclined upwardly. The upper guide rail 13, on the other hand, includes a first segment 131 which is substantially horizontal or inclined slightly upwardly from the starting position to the waiting position of the pouring pipe, and a final segment 132 which is inclined upwardly in a relatively steep manner into the region adjacent the casting opening 2 of the metallurgical vessel 3. Accordingly, the interaction between the guide rollers 11, 12 and the guide rails 13, 14 enables the pouring pipe 1 to be transferred from its substantially horizontal starting position to its substantially vertical waiting position, in such a manner that the head plate 6 attached to the upper end of the pouring pipe 1 is forced into the gap between the contact strips 19 of the rails 5 and the guide plate 8. To aid in guiding the head plate 6 onto the contact strips 19, the contact strips 19 are each formed with a sloping portion 20 thereon (see FIG. 2).

Figure 4:
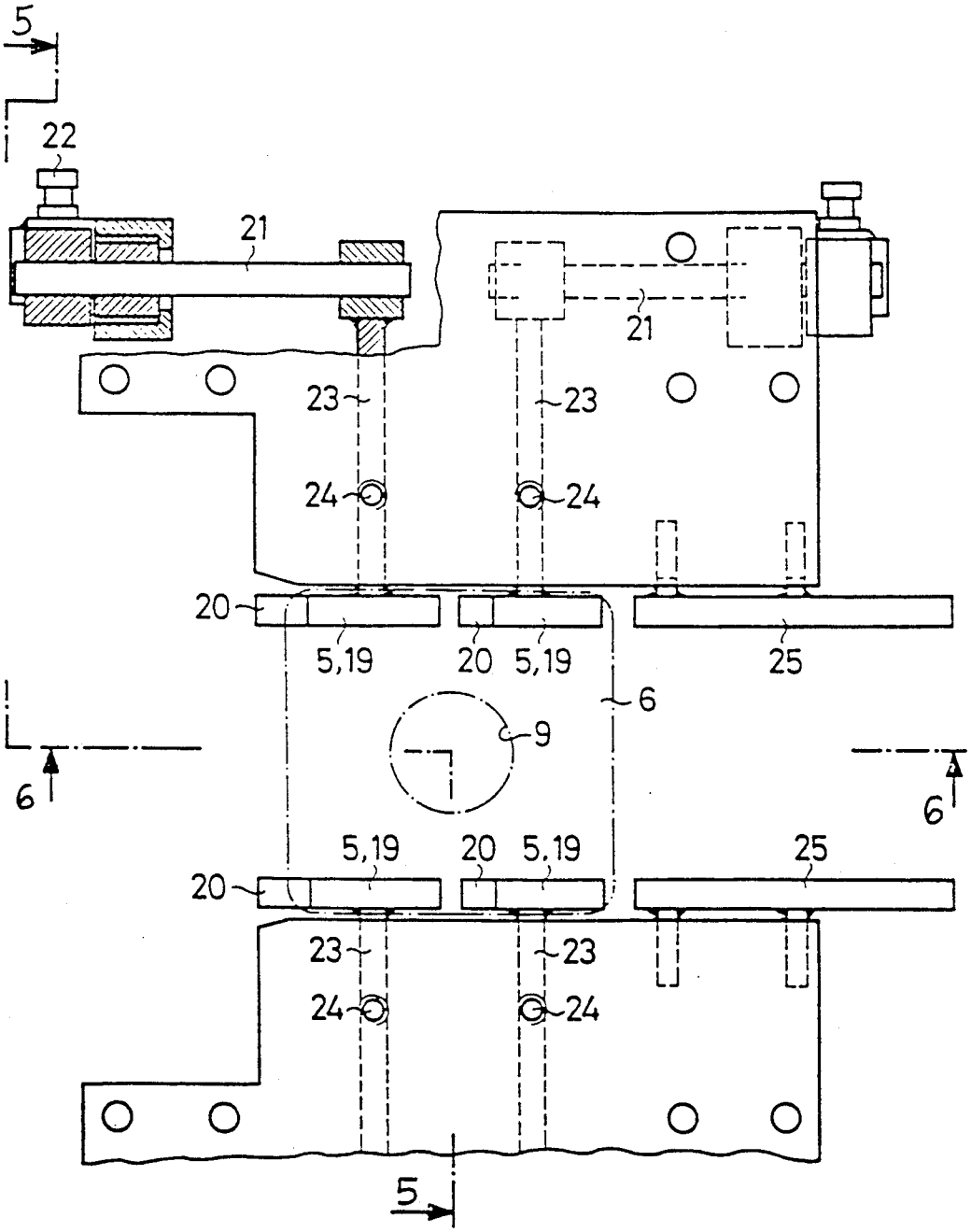
FIG. 4 is a schematic top view of a guide rail system for transporting the pouring pipe from its waiting position into its pouring position.
Figure 5:
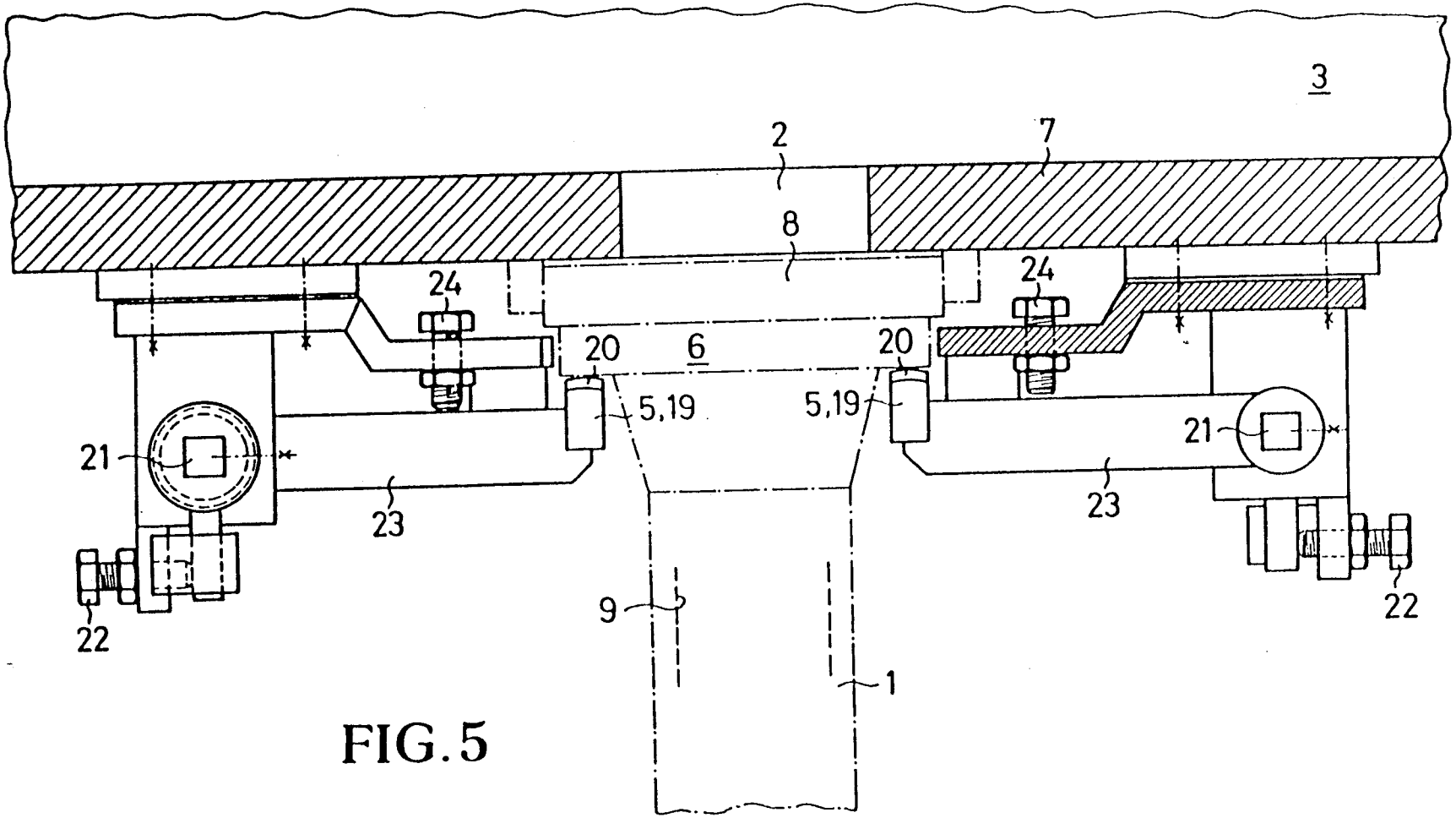
FIG. 5 is a cross-sectional view taken along line 5—5 of FIG. 4.
Figure 6:
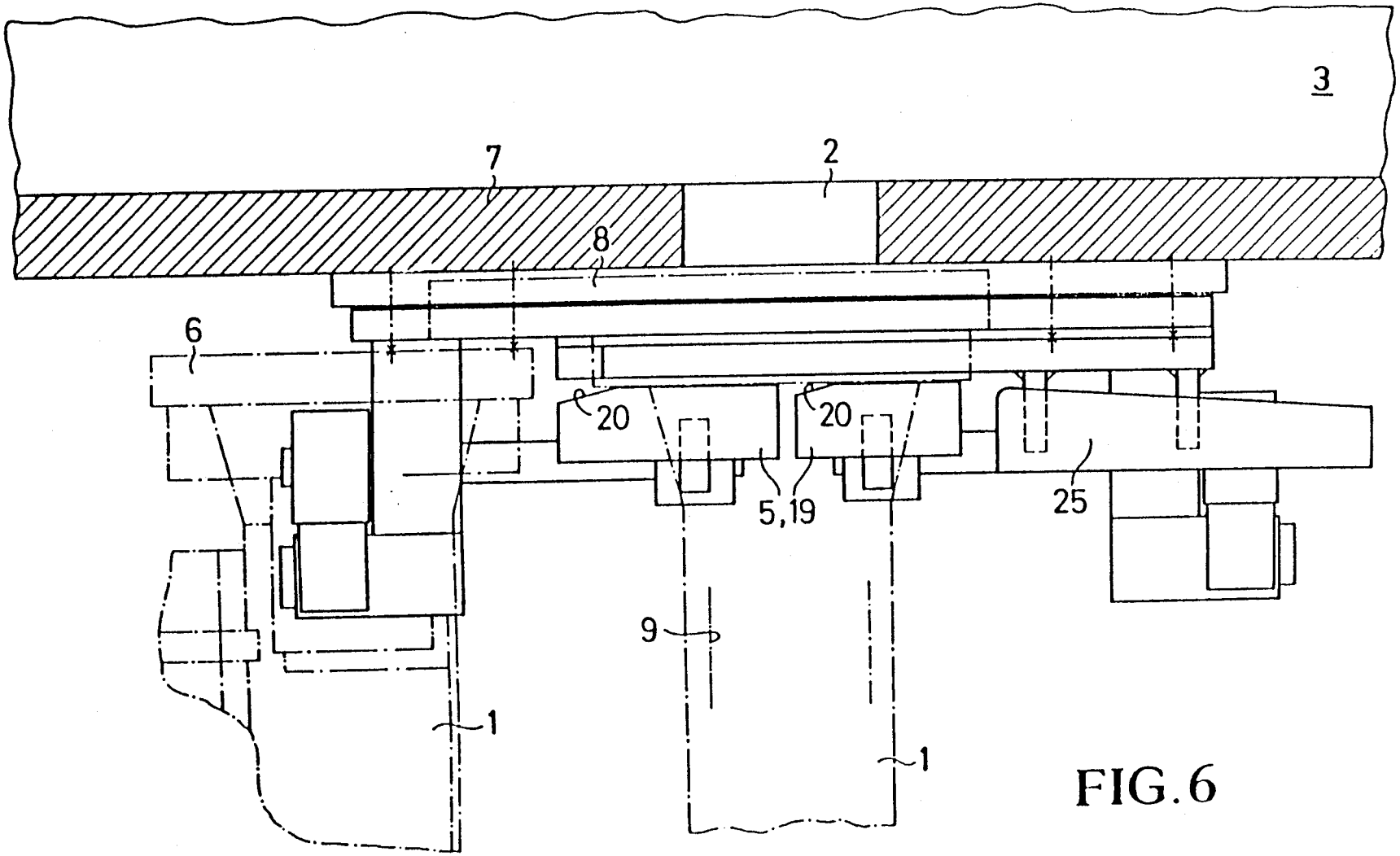
FIG. 6 is a cross-sectional view taken along line 6—6 of FIG. 4.

So as to ensure that the head plate 6 of the pouring pipe 1 is properly abutted against the guide plate 8 such that it forms a seal therebetween, a spring biasing means is provided to bias the contact strips 19 upwardly toward the guide plate 8, to thereby urge the head plate 6 against the guide plate 8. Although the spring biasing means can be formed by any suitable arrangement, in the preferred embodiment of the present invention as shown in FIGS. 4 and 5, the spring biasing means comprises a plurality of torsion rods 21 connected respectively to the contact strips 19 by way of swivel arms 23. The spring force provided by the torsion rods 21 can be adjusted by way of set screws 22, and the range of pivoting by the swivel arms 23 can be limited by way of adjustable stop means which, in the preferred embodiment, are adjustable stop screws 24.

The guide rails 5 also include seating shoulders 25 (see FIGS. 2 and 3) which are adapted to receive the head plate 6 of a worn or eroded pouring pipe 1 after it is moved from its pouring position. That is, when a new pouring pipe is moved from its waiting position to its pouring position to replace a worn or eroded pouring pipe, the worn or eroded pouring pipe is forced into a discharge position wherein its head plate 6 rests on a pair of seating shoulders 25 which, in the preferred embodiment, are sloped slightly downwardly away from the pouring position.

In order to force the truck 10 with the pouring pipe 1 suspended therefrom from a waiting position into a pouring position, a displacement mechanism is provided and includes an actuating rod 26. Although not shown, the actuating rod 26 is contemplated as being movable by a suitable actuating motor, such as a or other linear actuator, or even a rotary motor with a suitable linkage arrangement to cause the actuating rod 26 to be moved substantially linearly. The forwardmost end of the actuating rod 26 preferably engages with the axle 18 of the first guide roller 11, or with the guide roller 11 itself, so that the pushing force by the actuating rod 26 does not cause any significant tilting of the pouring pipe 1 during movement thereof from its starting position to its waiting position. When the pouring pipe reaches its waiting position, the guide rollers 11, 12 come into abutment with stop means 29, 30 which, in the preferred embodiment, are formed by a pair of adjustable stop screws. The provision of the stop means 29, 30 assures that the pouring pipe 1 will not be pushed beyond its waiting position, and the fact that the stop means are made adjustable allows the waiting position of the pouring pipe 1 to be adjusted such that, when in the waiting position, the pouring pipe is offset laterally from but properly aligned with the casting opening 2 of the metallurgical vessel 3. Further, the upper guide rail 13 is preferably provided with a recess 33 in its end nearest the starting position, and the actuating rod is provided with a pin 32 which is engageable in the recess 33 when the actuating rod 26 is in its most extended position, such that the actuating rod can be releasably locked in the extended position to hold the pouring pipe in its waiting position.

In operation, the pouring pipe 1 is first mounted in the truck 10, and the first and second guide rollers 11, 12 of the truck 10 are inserted respectively on the guide rails 13, 14 to place the pouring pipe 1 in its starting position. The actuating rod is then properly engaged with the axle 18 of the first guide roller 11, or with any other suitable part of the truck 10 or pouring pipe 1, and the actuating motor is actuated to extend the actuating rod 26 to thereby push the truck 10, and thus the pouring pipe 1, from the substantially horizontal starting position along the guide rails 13, 14 until the pouring pipe 1 pivots into a substantially vertical position and is located in a waiting position at which the truck 10 is stopped by abutment with stop means 29, 30. The pin 32 of the actuating rod 26 is then seated in the recess 33 of the upper guide rail 13 to hold pouring pipe 1 in its waiting position.

When it is necessary to make use of the pouring pipe 1 for pouring molten metal from the metallurgical vessel 3 into the mold 15, the pouring pipe 1 in the waiting position can be moved laterally by the pusher mechanism 4 such that the pouring pipe 1 is disengaged from the truck 10, and the head plate 6 of the pouring pipe 1 is guided up the sloped portions 20 of the contact strips 19 so as to be engaged between the contact strips 19 and the guide plate 8. In this position, the spring bias force of the torsion rods 21, which is transmitted to the contact strips 19 by the swivel arms 23, causes the contact strips, and thus the head plate 6 of the pouring pipe 1 to be forced upwardly into abutting engagement with the guide plate 8. In this position, the pouring position, molten metal can be poured from the metallurgical vessel, through the casting opening 2 and the flow channel 9 of the pouring pipe 1, and into the mold 15.

When the pouring pipe becomes worn or eroded beyond certain limits, it is necessary to then move another pouring pipe 1 from the waiting position into the pouring position. In so doing, the pusher mechanism 4 pushes the new pouring pipe 1 and simultaneously the worn or eroded pouring pipe 1 in the lateral direction relative to the guide rails 13, 14, such that the eroded pouring pipe 1 is moved along the guide rails 5 onto the seating shoulders 25 in the discharge position. From this discharge position, the eroded pouring pipe can be removed in any suitable manner.

With the arrangement of the present invention, a pouring pipe 1 can be automatically transferred from a remote substantially horizontal waiting position to the substantially vertical waiting position in which the pouring pipe 1 is laterally offset from but aligned with the casting opening 2 of the metallurgical vessel 3 and awaits movement from the waiting position to the pouring position. Since the only manual step in the method of inserting the pouring pipe 1 is that of mounting the pouring pipe 1 on the conveyor mechanism in its starting position, the operator of the continuous casting machine is free from working too near the operational area wherein temperatures are very high.

Although the present invention has been fully described with reference to the accompanying drawing figures, it is contemplated that many changes can be made without departing from the intended scope of the invention as defined in the appended claims.

What is claimed is:

1. A method of inserting a pouring pipe into a mold of a continuous casting machine and beneath a casting opening of a metallurgical vessel, comprising the steps of:

providing a conveyor in a region adjacent an upper opening of the mold;

mounting the pouring pipe on the conveyor in a substantially horizontal starting position outside of the mold;

transporting the pouring pipe along said conveyor from said substantially horizontal starting position to a substantially vertical waiting position wherein a lower end of the pouring pipe is inserted through the upper opening of the mold, and an upper end of the pouring pipe is offset from but substantially aligned with the casting opening of the metallurgical vessel, such that the pouring pipe in the waiting position can be subsequently pushed into a substantially vertical pouring position wherein the upper end of the pouring pipe is directly beneath the casting opening in the metallurgical vessel and the lower end of the pouring pipe remains inserted through the upper opening of the mold;

moving the pouring pipe from the substantially vertical waiting position into the substantially vertical pouring position;

wherein the pouring pipe has a head plate disposed at an upper end thereof, and a guide plate is disposed at a bottom wall of the metallurgical vessel; and wherein said step of moving the pouring pipe comprises actuating a pushing mechanism to push the pouring pipe such that the head plate of the pouring pipe is moved along the guide plate of the metallurgical vessel.

2. A method as recited in claim 1, further comprising the step of:

after the pouring pipe has been moved into the waiting position, removing at least part of said conveyor from the region adjacent the upper opening of the mold.

3. A method as recited in claim 1, wherein said step of transporting the pouring pipe comprises actuating a displacement mechanism including an actuating rod to push the pouring pipe along said conveyor from said starting position to said waiting position.

4. A method as recited in claim 1, wherein said step of mounting the pouring pipe comprises mounting the pouring pipe to a truck and mounting said truck on said conveyor.

5. An apparatus for inserting a pouring pipe into a mold of a continuous casting machine and beneath a casting opening of a metallurgical vessel, comprising:

a conveyor mounted adjacent an upper opening of the mold and comprising guide means for guiding the pouring pipe from a substantially horizontal starting position outside of the mold to a substantially vertical waiting position wherein a lower end of the pouring pipe is inserted through the upper opening of the mold, and an upper end of the pouring pipe is offset from but substantially aligned with the casting opening of the metallurgical vessel, such that the pouring pipe in the waiting position can be subsequently pushed into a substantially vertical pouring position wherein the upper end of the pouring pipe is directly beneath the casting opening in the metallurgical vessel and the lower end of the pouring pipe remains inserted through the upper opening of the mold;

transporting means for transporting the pouring pipe along said guide means from said starting position to said waiting position;

pusher means for pushing the pouring pipe from said waiting position into said pouring position;

wherein a head plate is provided at the upper end of the pouring pipe;

wherein a guide plate is provided at a bottom wall of the metallurgical vessel;

wherein a plurality of contact strips are mounted beneath said guide plate such that a gap is formed between said guide plate and said contact strips; and wherein said pusher means is operable to push the pouring pipe from said waiting position to said pouring position such that said head plate is forced into said gap between said guide plate and said contact strips.

6. An apparatus as recited in claim 5, further comprising biasing means for biasing said contact strips upwardly toward said guide plate.

7. An apparatus as recited in claim 5, wherein said contact strips include sloped portions on upper surfaces thereof upon which said head plate of the pouring pipe is adapted to ride.

8. An apparatus as recited in claim 5, wherein said biasing means comprises a plurality of torsion rods operatively connected to said contact strips, respectively.

9. An apparatus as recited in claim 8, further comprising biasing force adjusting means for adjusting the biasing force provided by said biasing means.

10. An apparatus as recited in claim 8, wherein said biasing means further comprises a plurality of swivel rods connected respectively between said torsion rods and said contact strips to transmit the biasing force from said torsion rods to said contact strips, respectively.

11. An apparatus as recited in claim 10, further comprising limiting means for adjustably limiting pivotal movement of said swivel arms toward said guide plate.

12. An apparatus as recited in claim 5, further comprising a plurality of seating shoulders substantially aligned with said contact strips along the direction in which said pushing means is operable to push the pouring pipe, said seating shoulders being mounted relative to said contact strips on a side of said contact strips opposite said waiting position, and being adapted to receive said head plate of the pouring pipe when the pouring pipe is forced from said pouring position, so as to define a discharge position for the pouring pipe.

13. An apparatus as recited in claim 5, wherein said transporting means comprises a displacement mechanism including an actuating rod mounted for movement along said guide means.

14. An apparatus as recited in claim 13, wherein said conveyor further comprises a truck means for receiving the pouring pipe, said truck means including a pair of spaced apart rollers;

said guide means comprises a pair of spaced apart guideways adapted to receive said pair of rollers, respectively; and said actuating rod is mounted for movement along one of said guideways.

15. An apparatus as recited in claim 14, wherein said actuating rod comprises means for engaging with one of said rollers to push said truck means along said guide means.

16. An apparatus as recited in claim 14, further comprising stop means for stopping displacement of the pouring pipe when it has reached said waiting position, said stop means being adjustable to adjust said waiting position of the pouring pipe.

17. An apparatus as recited in claim 5, wherein said pusher means is operable to push the pouring pipe from said waiting position to said pouring position along a direction substantially perpendicular to the direction in which said transporting means transports the pouring pipe from said starting position to said waiting position.

18. An apparatus as recited in claim 5, wherein said guide means comprises a pair of vertically spaced apart guideways extending from said starting position to said waiting position.

19. An apparatus as recited in claim 18, wherein said conveyor further comprises a truck means for receiving the pouring pipe and for connecting the pouring pipe to said guideways.

20. An apparatus as recited in claim 19, wherein said pair of guideways are respectively formed by a pair of guide rails; and said truck means comprises a pair of guide rollers adapted to be received by and guided along said pair of guide rails, respectively.

21. An apparatus as recited in claim 20, wherein said pair of guide rails includes an upper guide rail and a lower guide rail; and said upper guide rail comprises two guide legs spaced vertically apart at a constant distance.

22. An apparatus as recited in claim 21, wherein said pair of guide rollers includes a first guide roller and a second guide roller, said first guide roller comprising two spaced apart roller members mounted for rotation about a common axis; and said pair of guide rails includes an upper guide rail and a lower guide rail, said first guide roller being adapted to be received between said guide legs of said upper guide rail.

23. An apparatus as recited in claim 18, wherein said pair of guideways comprises an upper guideway and a lower guideway spaced below said upper guideway; and said lower guideway comprises three continuous guideway segments including a first substantially horizontal segment disposed at said starting position of the pouring pipe, a second segment sloped downwardly from said first segment and a third segment extending approximately horizontally from said second segment to said waiting position of the pouring pipe.

24. An apparatus as recited in claim 23, wherein said upper guideway comprises two continguous segments including a fourth approximately horizontal segment extending from said starting position toward said waiting position, and a fifth segment which slopes upwardly from said fourth segment to said waiting position.

25. An apparatus as recited in claim 18, wherein said pair of guideways comprises an upper guideway and a lower guideway spaced below said upper guideway; and said upper guideway comprises two continuous segments including a fourth nearly horizontal segment extending from said starting position toward said waiting position, and a fifth segment which slopes upwardly from said fourth segment to said waiting position.

26. A method as recited in claim 1, wherein movement of the pouring pipe from the waiting position to the pouring position is carried out along a plane perpendicular to a plane along which the pouring pipe is moved form the starting position to the waiting position.

27. A method as recited in claim 26, further comprising the step of:

after the pouring pipe has been moved into the waiting position, removing at least part of said conveyor from the region adjacent the upper opening of the mold.

28. A method as recited in claim 26, wherein said step of transporting the pouring pipe comprises actuating a displacement mechanism including an actuating rod to push the pouring pipe along said conveyor from said starting position to said waiting position.

29. A method as recited in claim 26, wherein said step of mounting the pouring pipe comprises mounting the pouring pipe to a truck and mounting said truck on said conveyor.

30. An apparatus as recited in claim 5, wherein said conveyor is mounted along a plane perpendicular to a plane along which said pusher means is operable to push the pouring pipe form said waiting position to said pouring position.

31. An apparatus as recited in claim 30, further comprising biasing means for biasing said contact strips upwardly toward said guide plate.

32. An apparatus as recited in claim 30, wherein said contact strips include sloped portions on upper surfaces thereof upon which said head plate of the pouring pipe is adapted to ride.

33. An apparatus as recited in claim 30, wherein said biasing means comprises a plurality of torsion rods operatively connected to said contact strips, respectively.

34. An apparatus as recited in claim 30, further comprising a plurality of seating shoulders substantially aligned with said contact strips along the direction in which said pushing means is operable to push the pouring pipe, said seating shoulders being mounted relative to said contact strips on a side of said contact strips opposite said waiting position, and being adapted to receive said head plate of the pouring pipe when the pouring pipe is forced from said pouring position, so as to define a discharge position for the pouring pipe.

35. An apparatus as recited in claim 30, wherein said transporting means comprises a displacement mechanism including an actuating rod mounted for movement along said guide means.

36. An apparatus as recited in claim 30, wherein said pusher means is operable to push the pouring pipe from said waiting position to said pouring position along a direction substantially perpendicular to the direction in which said transporting means transports the pouring pipe from said starting position to said waiting position.

37. An apparatus as recited in claim 30, wherein said guide means comprises a pair of vertically spaced apart guideways extending from said starting position to said waiting position.

38. A method of inserting a pouring pipe into a mold of a continuous casting machine and beneath a casting opening of a metallurgical vessel, comprising the steps of:

providing a conveyor in a region adjacent an upper opening of the mold;

mounting the pouring pipe on the conveyor in a substantially horizontal starting position outside of the mold;

transporting the pouring pipe along said conveyor from said substantially horizontal starting position to a substantially vertical waiting position wherein a lower end of the pouring pipe is inserted through the upper opening of the mold, and an upper end of the pouring pipe is offset from but substantially aligned with the casting opening of the metallurgical vessel, such that the pouring pipe in the waiting position can be subsequently pushed into a substantially vertical pouring position wherein the upper end of the pouring pipe is directly beneath the casting opening in the metallurgical vessel and the lower end of the pouring pipe remains inserted through the upper opening of the mold; and wherein said step of mounting the pouring pipe comprises mounting the pouring pipe to a truck and mounting said truck on said conveyor.

39. An apparatus for inserting a pouring pipe into a mold of a continuous casting machine and beneath a casting opening of a metallurgical vessel, comprising:

a conveyor mounted adjacent an upper opening of the mold and comprising guide means for guiding the pouring pipe from a substantially horizontal starting position outside of the mold to a substantially vertical waiting position wherein a lower end of the pouring pipe is inserted through the upper opening of the mold, and an upper end of the pouring pipe is offset from but substantially aligned with the casting opening of the metallurgical vessel, such that the pouring pipe in the waiting position can be subsequently pushed into a substantially vertical pouring position wherein the upper end of the pouring pipe is directly beneath the casting opening in the metallurgical vessel and the lower end of the pouring pipe remains inserted through the upper opening of the mold;

transporting means for transporting the pouring pipe along said guide means from said starting position to said waiting position;

pusher means for pushing the pouring pipe from said waiting position into said pouring position;

wherein said transporting means comprises a displacement mechanism including an actuating rod mounted for movement along said guide means;

wherein said conveyor further comprises a truck means for receiving the pouring pipe, said truck means including a pair of spaced apart rollers;

wherein said guide means comprises a pair of spaced apart guideways adapted to receive said pair of rollers, respectively; and wherein said actuating rod is mounted for movement along one of said guideways.

40. An apparatus for inserting a pouring pipe into a mold of a continuous casting machine and beneath a casting opening of a metallurgical vessel, comprising:

a conveyor mounted adjacent an upper opening of the mold and comprising guide means for guiding the pouring pipe from a substantially horizontal starting position outside of the mold to a substantially vertical waiting position wherein a lower end of the pouring pipe is inserted through the upper opening of the mold, and an upper end of the pouring pipe is offset from but substantially aligned with the casting opening of the metallurgical vessel, such that the pouring pipe in the waiting position can be subsequently pushed into a substantially vertical pouring position wherein the upper end of the pouring pipe is directly beneath the casting opening in the metallurgical vessel and the lower end of the pouring pipe remains inserted through the upper opening of the mold;

transporting means for transporting the pouring pipe along said guide means from said starting position to said waiting position; and wherein said guide means comprises a pair of vertically spaced apart guideways extending from said starting position to said waiting position.

* * * * *